US008878765B2

(12) United States Patent
Shin et al.

(10) Patent No.: US 8,878,765 B2
(45) Date of Patent: Nov. 4, 2014

(54) GATE SHIFT REGISTER AND DISPLAY DEVICE USING THE SAME

(75) Inventors: Hongjae Shin, Seoul (KR); Byunghyun Park, Paju-si (KR); Miyoung Son, Uijeongbu-si (KR)

(73) Assignee: LG Display Co., Ltd., Seoul (KR)

( * ) Notice: Subject to any disclaimer, the term of this patent is extended or adjusted under 35 U.S.C. 154(b) by 868 days.

(21) Appl. No.: 12/913,632

(22) Filed: Oct. 27, 2010

(65) Prior Publication Data

US 2011/0273417 A1 Nov. 10, 2011

(30) Foreign Application Priority Data

May 7, 2010 (KR) ..... 10-2010-0042967

(51) Int. Cl.
*G09G 3/36* (2006.01)
*G09G 3/20* (2006.01)

(52) U.S. Cl.
CPC ..... *G09G 3/20* (2013.01); *G09G 2310/0267* (2013.01); *G09G 2310/0286* (2013.01)
USPC ..... 345/100; 345/98; 345/99; 377/64; 377/67

(58) Field of Classification Search
CPC ..... G09G 2310/0267; G09G 2310/0286; G09G 3/3674
USPC ..... 345/98–100; 377/64–81
See application file for complete search history.

(56) References Cited

U.S. PATENT DOCUMENTS

2005/0008114 A1* 1/2005 Moon ..... 377/64
2008/0056431 A1* 3/2008 Chien et al. ..... 377/79
2009/0167668 A1* 7/2009 Kim ..... 345/100

FOREIGN PATENT DOCUMENTS

CN 1868003 11/2006
TW 200813918 A 3/2008

* cited by examiner

*Primary Examiner* — William Boddie
*Assistant Examiner* — Saifeldin Elnafia
(74) *Attorney, Agent, or Firm* — McKenna Long & Aldridge LLP

(57) ABSTRACT

A gate shift register and a display device using the same are disclosed. The gate shift register includes a plurality of stages that receive a plurality of gate shift clocks and sequentially output a scan pulse. A k-th stage of the plurality of stages includes a scan direction controller for converting a shift direction of the scan pulse in response to carry signals of previous stages input through first and second input terminals and carry signals of next stages input through third and fourth input terminals, a node controller for controlling charging and discharge operations of each of Q1, Q2, QB1, and QB2 nodes, a floating prevention unit for applying a low potential voltage to a gate electrode of a discharge TFT based on a voltage of the QB1 node or the QB2 node, and an output unit for outputting first and second scan pulses.

16 Claims, 9 Drawing Sheets

GATE SHIFT REGISTER AND DISPLAY DEVICE USING THE SAME

This application claims the benefit of Korea Patent Application No. 10-2010-0042967 filed on May 7, 2010, which is incorporated herein by reference for all purposes as if fully set forth herein.

BACKGROUND OF THE INVENTION

1. Field of the Invention

Exemplary embodiments of the invention relate to a gate shift register and a display device using the same.

2. Discussion of the Related Art

Various flat panel displays capable of reducing the weight and the size of a cathode ray tube have been developed and have been put on the market. In general, a scan driving circuit of the flat panel display sequentially supplies a scan pulse to scan lines using a gate shift register.

The gate shift register of the scan driving circuit includes a plurality of stages each including a plurality of thin film transistors (TFTs). The stages are cascade-connected to one another and sequentially generate an output.

Each of the stages includes a Q node for controlling a pull-up transistor and a Q bar (QB) node for controlling a pull-down transistor. Further, each of the stages includes a plurality of switching circuits for charging and discharging the Q node and the QB node to a predetermined voltage in response to a carry signal input from a previous stage, a carry signal input from a next stage, and a clock.

Such a related art gate shift register generates the scan pulse in only one direction, i.e., in only a direction from a stage positioned at an uppermost side to a stage positioned at a lowermost side. Thus, it is impossible to apply the related art gate shift register to various kinds of display devices, for example, a display device sequentially displaying an image in a direction from a lowermost scan line to an uppermost scan line of a display panel. The related art gate shift register does not satisfy various demands of companies of the display devices. Accordingly, a bidirectional gate shift register capable of performing a bidirectional shift operation has been recently proposed. The bidirectional gate shift register includes a bidirectional control circuit and operates in a forward shift mode or a reverse shift mode.

However, the bidirectional gate shift register causes several problems because of the bidirectional control circuit added to a unidirectional gate shift register. Because the bidirectional control circuit is floated after a shift direction conversion signal is applied to a discharge TFT connected between the QB node and an input terminal of a low potential voltage in each stage, a gate electrode of the discharge TFT is floated. Leakage charges are accumulated in the floated gate electrode of the discharge TFT during an operation of the gate shift register, and thus a voltage between the gate electrode and a source electrode of the discharge TFT exceeds a threshold voltage. As a result, the discharge TFT that has to be held in a turn-off state is abnormally turned on. In this case, the QB node is not charged to a voltage level capable of turning on the pull-down transistor during a period in which an output signal of the stage has to be held at a low level, and as a result, the output signal is not held at a gate low level and gradually increases. Further, a degradation of the discharge TFT accelerates because of a gate-bias stress resulting from the leakage charges, and a life span of the gate shift register shortens.

SUMMARY OF THE INVENTION

Exemplary embodiments of the invention provide a gate shift register and a display device using the same capable of preventing a floating and a degradation of a discharge thin film transistor (TFT), that is connected between a QB node and an input terminal of a low potential voltage in each stage and operates in response to a shift direction conversion signal, and stabilizing an output of each stage.

In one aspect, there is a gate shift register comprising a plurality of stages configured to receive a plurality of gate shift clocks and sequentially output a scan pulse, wherein a k-th stage of the plurality of stages includes a scan direction controller configured to convert a shift direction of the scan pulse in response to carry signals of previous stages input through first and second input terminals and carry signals of next stages input through third and fourth input terminals, a node controller configured to control charging and discharge operations of each of a Q1 node, a Q2 node, a QB1 node, and a QB2 node, the node controller including a discharge thin film transistor (TFT) configured to discharge the QB1 node or the QB2 node to a low potential voltage in response to a shift direction conversion signal, a floating prevention unit configured to apply the low potential voltage to a gate electrode of the discharge TFT based on a voltage of the QB1 node or the QB2 node, and an output unit configured to output a first scan pulse through a first output node and a second scan pulse through a second output node based on voltages of the Q1, Q2, QB1, and QB2 nodes.

The discharge TFT includes a first discharge TFT connected between the QB1 node and an input terminal of the low potential voltage and a second discharge TFT connected between the QB2 node and the input terminal of the low potential voltage. The floating prevention unit includes a first floating prevention TFT configured to switch on or off a current path between a gate electrode of the first discharge TFT and the input terminal of the low potential voltage based on the voltage of the QB1 node and a second floating prevention TFT configured to switch on or off a current path between a gate electrode of the second discharge TFT and the input terminal of the low potential voltage based on the voltage of the QB2 node.

The k-th stage further includes a degradation prevention strengthening unit configured to apply the low potential voltage to the gate electrode of the discharge TFT based on a voltage of the first output node or the second output node.

The degradation prevention strengthening unit includes a first strengthening TFT configured to switch on or off a current path between the gate electrode of the first discharge TFT and the input terminal of the low potential voltage based on the voltage of the first output node and a second strengthening TFT configured to switch on or off a current path between the gate electrode of the second discharge TFT and the input terminal of the low potential voltage based on the voltage of the second output node.

Each of the plurality of gate shift clocks has a pulse width of three horizontal periods and is generated as a 6-phase cycle clock whose a phase is shifted every one horizontal period. Adjacent gate shift clocks of the plurality of gate shift clocks overlap each other during two horizontal periods.

The first scan pulse is supplied to a first scan line, and at the same time, serves as a first carry signal. The second scan pulse is supplied to a second scan line, and at the same time, serves as a second carry signal. The first input terminal is connected to a second output node of a (k−2)th stage, the second input terminal is connected to a first output node of a (k−1)th stage, the third input terminal is connected to a second output node of a (k+1)th stage, and the fourth input terminal is connected to a first output node of a (k+2)th stage.

The scan direction controller includes a first forward TFT configured to apply a forward driving voltage to the Q1 node in response to a second carry signal of the (k−2)th stage input through the first input terminal, a second forward TFT configured to apply the forward driving voltage to the Q2 node in response to a first carry signal of the (k−1)th stage input through the second input terminal, a third forward TFT configured to apply the forward driving voltage to the gate electrode of the discharge TFT as the shift direction conversion signal in response to the second carry signal of the (k−2)th stage input through the first input terminal, a first reverse TFT configured to apply a reverse driving voltage to the Q1 node in response to a second carry signal of the (k+1)th stage input through the third input terminal, a second reverse TFT configured to apply the reverse driving voltage to the Q2 node in response to a first carry signal of the (k+2)th stage input through the fourth input terminal, and a third reverse TFT configured to apply the reverse driving voltage to the gate electrode of the discharge TFT as the shift direction conversion signal in response to the first carry signal of the (k+2)th stage input through the fourth input terminal.

In a forward shift mode in which the second scan pulse is generated following the first scan pulse, carry signals input to the first and second input terminals serve as a start signal indicating a charging time of the Q1 node or the Q2 node, and carry signals input to the third and fourth input terminals serve as a reset signal indicating a discharge time of the Q1 node or the Q2 node. In a reverse shift mode in which the first scan pulse is generated following the second scan pulse, carry signals input to the third and fourth input terminals serve as a start signal indicating a charging time of the Q1 node or the Q2 node, and carry signals input to the first and second input terminals serve as a reset signal indicating a discharge time of the Q1 node or the Q2 node.

The QB1 node is charged and discharged reverse to the Q1 and Q2 nodes during an odd frame and is held in a discharge state during an even frame. The QB2 node is charged and discharged reverse to the Q1 and Q2 nodes during the even frame and is held in a discharge state during the odd frame.

In another aspect, there is a display device comprising a display panel including data lines and scan lines crossing each other and a plurality of pixels arranged in a matrix form, a data driving circuit configured to supply a data voltage to the data lines, and a scan driving circuit configured to sequentially supply a scan pulse to the scan lines. The scan driving circuit includes a plurality of stages that receive a plurality of gate shift clocks, whose phases are sequentially shifted, and are cascade-connected to one another. A k-th stage of the plurality of stages includes a scan direction controller configured to convert a shift direction of the scan pulse in response to carry signals of previous stages input through first and second input terminals and carry signals of next stages input through third and fourth input terminals, a node controller configured to control charging and discharge operations of each of a Q1 node, a Q2 node, a QB1 node, and a QB2 node, the node controller including a discharge thin film transistor (TFT) configured to discharge the QB1 node or the QB2 node to a low potential voltage in response to a shift direction conversion signal, a floating prevention unit configured to apply the low potential voltage to a gate electrode of the discharge TFT based on a voltage of the QB1 node or the QB2 node, and an output unit configured to output a first scan pulse through a first output node and a second scan pulse through a second output node based on voltages of the Q1, Q2, QB1, and QB2 nodes.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Figure 1:
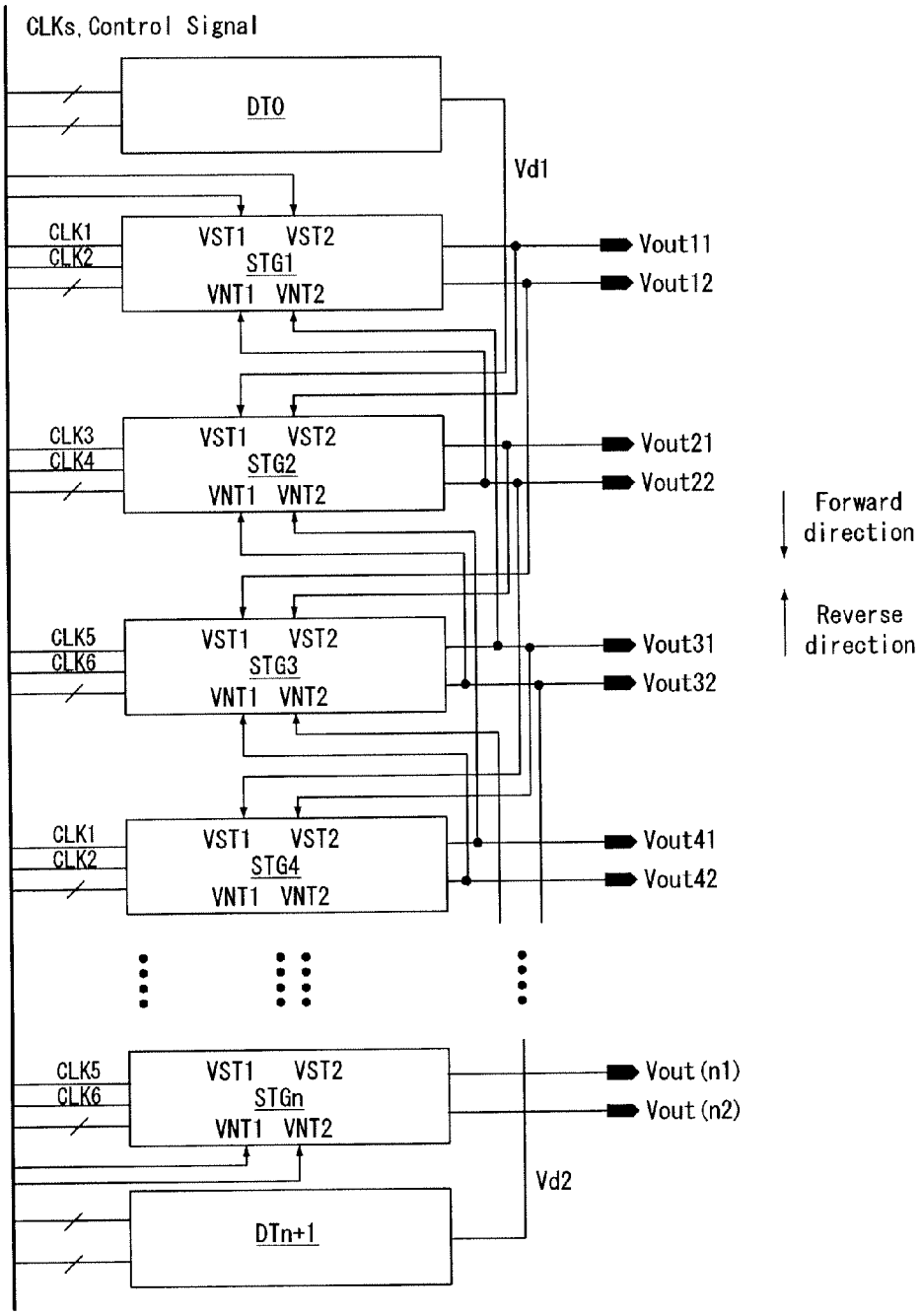
FIG. 1 schematically illustrates a configuration of a gate shift register according to an exemplary embodiment of the invention.

The invention will be described more fully hereinafter with reference to the accompanying drawings, in which example embodiments of the inventions are shown. This invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

Names of elements used in the following description are selected in consideration of facility of specification preparation. Thus, the names of the elements may be different from names of elements used in a real product.

FIG. 1 schematically illustrates a configuration of a gate shift register according to an exemplary embodiment of the invention. As shown in FIG. 1, a gate shift register according to an exemplary embodiment of the invention includes a plurality of cascade-connected stages STG1 to STGn and at least two dummy stages DT0 and DT(n+1).

Each of the stages STG1 to STGn has two output channels and outputs two scan pulses. The scan pulse is applied to scan lines of a display device, and at the same time, serves as a carry signal transferred to a previous stage and a next stage. In the following description, the previous stage indicates a stage positioned above a reference stage, for example, one stage of a (k−1)th stage STG(k−1) to a first dummy stage DT0 based on a k-th stage STG(k), where k is 1<k<n. The next stage indicates a stage positioned under the reference stage, for example, one stage of a (k+1)th stage STG(k+1) to a second dummy stage DT(n+1) based on the k-th stage STG(k). The first dummy stage DT0 outputs a carry signal Vd1 to be input to the next stage, and the second dummy stage DT(n+1) outputs a carry signal Vd2 to be input to the previous stage.

In a forward shift mode, the stages STG1 to STGn output scan pulses Vout11→Voutn2 in the order of the first stage STG1 to the n-th stage STGn via the k-th stage STG(k). In the forward shift mode, each of the stages STG1 to STGn operates in response to carry signals of two different previous stages applied to first and second input terminals VST1 and VST2 as a start signal and carry signals of two different next stages applied to third and fourth input terminals VNT1 and VNT2 as a reset signal. In the forward shift mode, a forward gate start pulse from the outside (i.e., a timing controller) is applied to first and second input terminals VST1 and VST2 of the first stage STG1.

In a reverse shift mode, the stages STG1 to STGn output scan pulses Voutn2→Vout11 in the order of the n-th stage STGn to the first stage STG1 via the k-th stage STG(k) in a forward shift mode. In the reverse shift mode, each of the stages STG1 to STGn operates in response to carry signals of two different previous stages applied to the first and second input terminals VST1 and VST2 as a reset signal and carry signals of two different next stages applied to the third and fourth input terminals VNT1 and VNT2 as a start signal. In the reverse shift mode, a reverse gate start pulse from the outside is applied to third and fourth input terminals VNT1 and VNT2 of the n-th stage STGn.

The gate shift register outputs scan pulses Vout11 to Voutn2 that overlap one another for a predetermined period of time. For this, two gate shift clocks of i-phase gate shift clocks, that overlap one another for a predetermined period of time and are sequentially delayed, are input to each of the stages STG1 to STGn, where i is a positive integer. It is preferable that the gate shift clocks are implemented as 6 or more-phase gate shift clocks so as to secure a sufficient charging time in a high speed drive equal to or greater than 240 Hz. Each of the 6-phase gate shift clocks CLK1 to CLK6 had a pulse width of three horizontal periods and is shifted every one horizontal period. Further, the adjacent gate shift clocks of the 6-phase gate shift clocks CLK1 to CLK6 overlap each other during two horizontal periods. The 6-phase gate shift clocks CLK1 to CLK6 are described below in detail.

Figure 3:
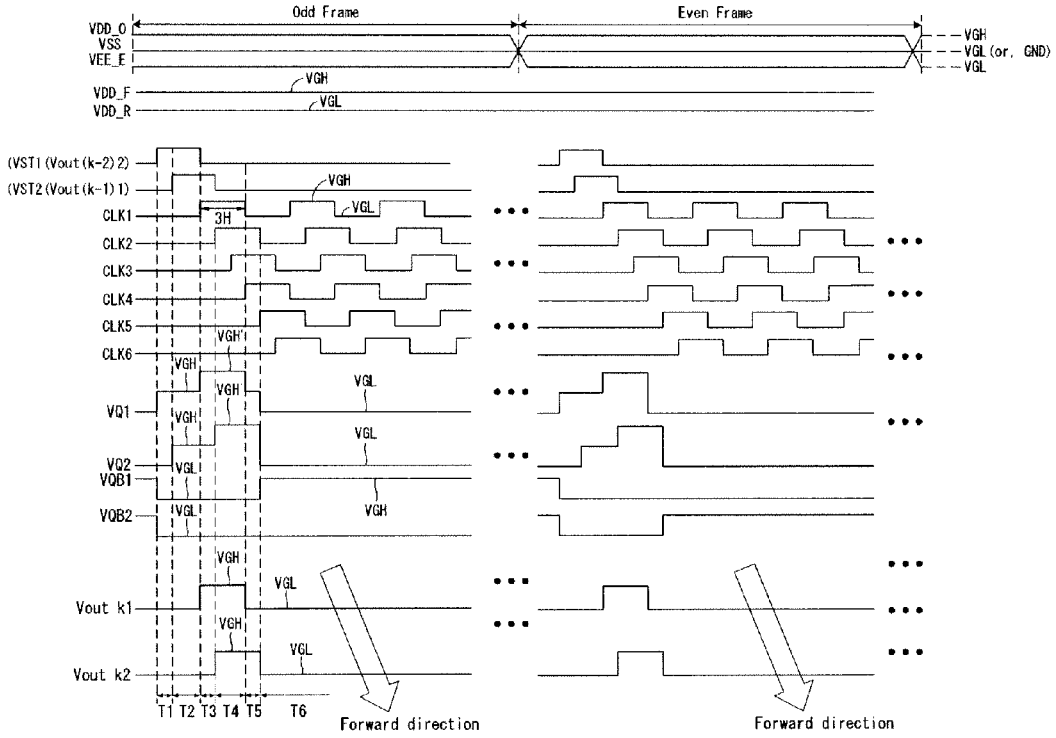
FIG. 3 illustrates input and output signals of a k-th stage during a forward shift operation.
Figure 4:
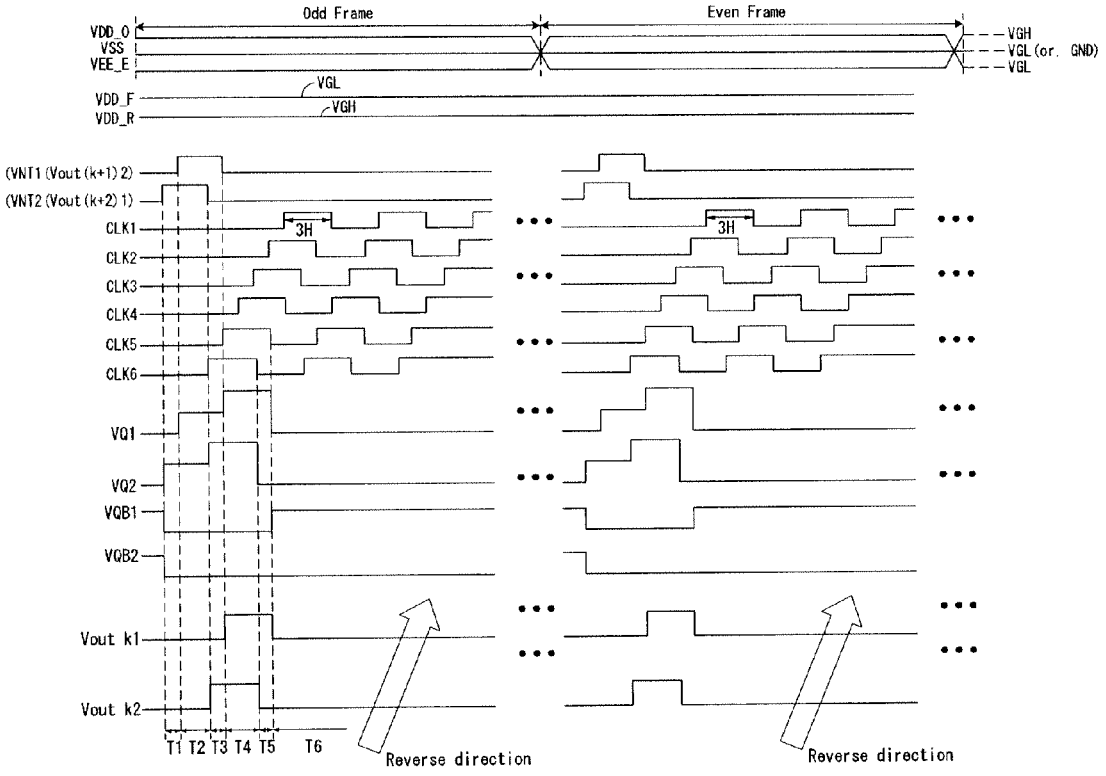
FIG. 4 illustrates input and output signals of a k-th stage during a reverse shift operation.

The 6-phase gate shift clocks CLK1 to CLK6 swing between a gate high voltage VGH and a gate low voltage VGL. As shown in FIGS. 3 and 4, alternating current (AC) driving voltages VDD_E and VDD_O, that have a phase difference of 180° between the gate high voltage VGH and the gate low voltage VGL every a predetermined period and swing in opposite directions, are supplied to the stages STG1 to STGn. Further, a ground level voltage GND or a low potential voltage VSS of the same level as the gate low voltage VGL is supplied to the stages STG1 to STGn. As shown in FIG. 3, in the forward shift mode, a forward driving voltage VDD_F of the same level as the gate high voltage VGH and a reverse driving voltage VDD_R of the same level as the gate low voltage VGL are supplied to the stages STG1 to STGn. As shown in FIG. 4, in the reverse shift mode, the reverse driving voltage VDD_R of the same level as the gate high voltage VGH and the forward driving voltage VDD_F of the same level as the gate low voltage VGL are supplied to the stages STG1 to STGn. The gate high voltage VGH is set to a voltage equal to or greater than a threshold voltage of thin film transistors (TFTs) formed in a TFT array of the display device, and the gate low voltage VGL is set to a voltage less than the threshold voltage of the TFTs formed in the TFT array of the display device. The gate high voltage VGH may be set to about 20V to 30V, and the gate low voltage VGL may be set to about −5V.

Figure 2:
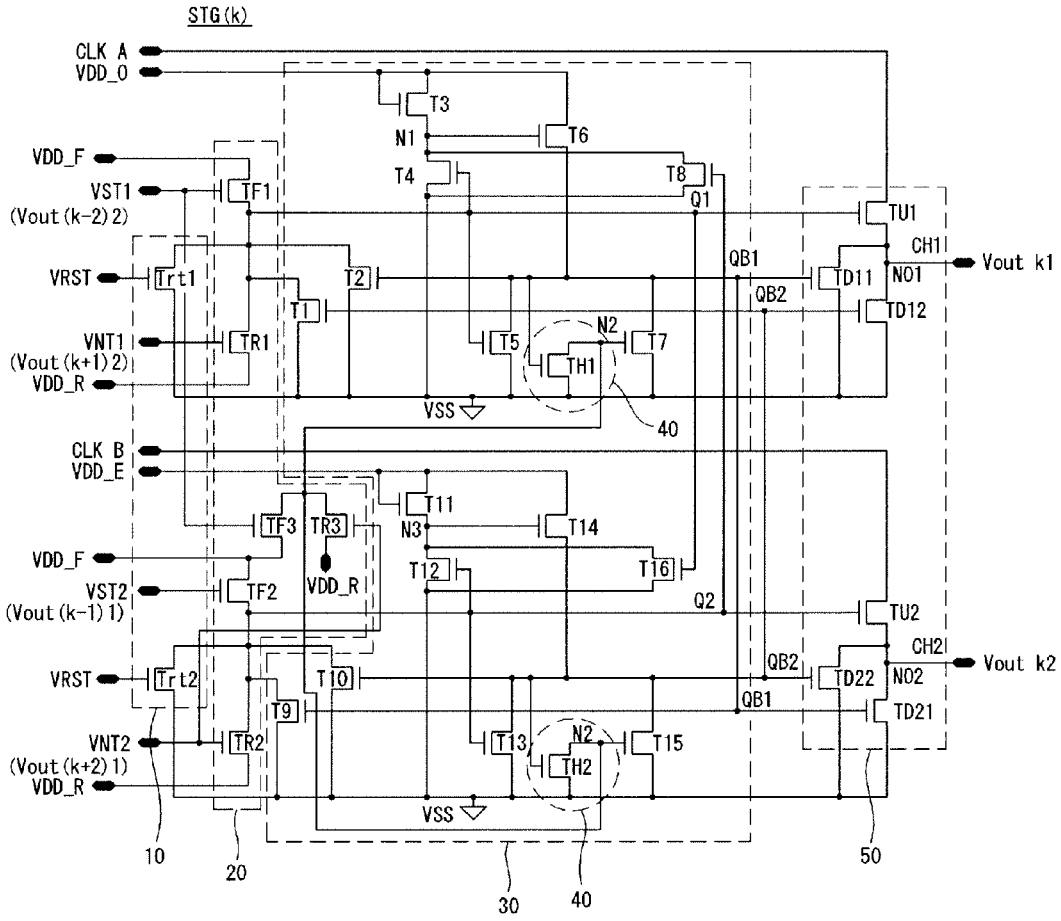
FIG. 2 illustrates an exemplary circuit configuration of a k-th stage.

FIG. 2 illustrates an exemplary circuit configuration of the k-th stage STG(k). Other stages each have substantially the same circuit configuration as the k-th stage STG(k).

As shown in FIG. 2, two adjacent generated gate shift clocks CLK A and CLK B among the 6-phase gate shift clocks CLK1 to CLK6 are input to a clock terminal of the k-th stage STG(k).

The k-th stage STG(k) includes an initialization unit 10 for initializing a Q1 node and a Q2 node in response to a frame reset signal VRST, a scan direction controller 20 for converting a scan direction in response to carry signals of previous stages input through the first and second input terminals VST1 and VST2 and carry signals of next stages input through the third and fourth input terminals VNT1 and VNT2, a node controller 30 for controlling charging and discharge operations of the Q1 node, the Q2 node, a QB1 node, and a QB2 node, a floating prevention unit 40 for preventing a floating of discharge TFTs controlled based on a voltage of a second node N2, and an output unit 50 for outputting two scan pulses Vout(k1) and Vout(k2) based on voltages of the Q1, Q2, QB1, and QB2 nodes.

The initialization unit 10 includes a first reset TFT Trt1 and a second reset TFT Trt2. The first reset TFT Trt1 initializes the Q1 node to the low potential voltage VSS in response to the frame reset signal VRST. The low potential voltage VSS may be set to the ground level voltage GND or the gate low voltage VGL. A gate electrode of the first reset TFT Trt1 is connected to an input terminal of the frame reset signal VRST, a drain electrode of the first reset TFT Trt1 is connected to the Q1 node, and a source electrode of the first reset TFT Trt1 is connected to an input terminal of the low potential voltage VSS. The second reset TFT Trt2 initializes the Q2 node to the low potential voltage VSS in response to the frame reset signal VRST. A gate electrode of the second reset TFT Trt2 is connected to the input terminal of the frame reset signal VRST, a drain electrode of the second reset TFT Trt2 is connected to the Q2 node, and a source electrode of the second reset TFT Trt2 is connected to the input terminal of the low potential voltage VSS.

The scan direction controller 20 includes first to third forward TFTs TF1 to TF3 and first to third reverse TFTs TR1 to TR3. The first forward TFT TF1 applies the forward driving voltage VDD_F to the Q1 node in response to a second carry signal Vout(k−2)2 of a (k−2)th stage STG(k−2) input through the first input terminal VST1. A gate electrode of the first forward TFT TF1 is connected to the first input terminal VST1, a drain electrode of the first forward TFT TF1 is connected to an input terminal of the forward driving voltage VDD_F, and a source electrode of the first forward TFT TF 1 is connected to the Q1 node. The first reverse TFT TR1 applies the reverse driving voltage VDD_R to the Q1 node in response to a second carry signal Vout(k+1)2 of a (k+1)th stage STG(k+1) input through the third input terminal VNT1. A gate electrode of the first reverse TFT TR1 is connected to the third input terminal VNT1, a drain electrode of the first reverse TFT TR1 is connected to an input terminal of the reverse driving voltage VDD_R, and a source electrode of the first reverse TFT TR1 is connected to the Q1 node. The second forward TFT TF2 applies the forward driving voltage VDDF to the Q2 node in response to a first carry signal Vout(k−1)1 of a (k−1)th stage STG(k−1) input through the second input terminal VST2. A gate electrode of the second forward TFT TF2 is connected to the second input terminal VST2, a drain electrode of the second forward TFT TF2 is connected to the input terminal of the forward driving voltage VDD_F, and a source electrode of the second forward TFT TF2 is connected to the Q2 node. The second reverse TFT TR2 applies the reverse driving voltage VDD_R to the Q2 node in response to a first carry signal Vout(k+2)1 of a (k+2)th stage STG(k+2) input through the fourth input terminal VNT2. A gate electrode of the second reverse TFT TR2 is connected to the fourth input terminal VNT2, a drain electrode of the second reverse TFT TR2 is connected to the input terminal of the reverse driving voltage VDD_R, and a source electrode of the second reverse TFT TR2 is connected to the Q2 node. The third forward TFT TF3 applies the forward driving voltage VDD_F to the second node N2 in response to the second carry signal Vout(k−2)2 of the (k−2)th stage STG (k−2) input through the first input terminal VST1. A gate electrode of the third forward TFT TF3 is connected to the first input terminal VST1, a drain electrode of the third forward TFT TF3 is connected to the input terminal of the forward driving voltage VDD_F, and a source electrode of the third forward TFT TF3 is connected to the second node N2. The third reverse TFT TR3 applies the reverse driving voltage VDD_R to the second node N2 in response to the first carry signal Vout(k+2)1 of the (k+2)th stage STG(k+2) input through the fourth input terminal VNT2. A gate electrode of the third reverse TFT TR3 is connected to the fourth input terminal VNT2, a drain electrode of the third reverse TFT TR3 is connected to the input terminal of the reverse driving voltage VDD_R, and a source electrode of the third reverse TFT TR3 is connected to the second node N2.

The node controller 30 includes first and second TFTs T1 and T2 for controlling the Q1 node, ninth and tenth TFTs T9 and T10 for controlling the Q2 node, third to eighth TFTs T3 to T8 for controlling the QB1 node, and eleventh to sixteenth TFTs T11 to T16 for controlling the QB2 node. The seventh TFT T7 serves as a discharge TFT for discharging the QB1 node, and the fifteenth TFT T15 serve as a discharge TFT for discharging the QB2 node. Because the QB1 node and the QB2 node are alternately activated every a predetermined period, for example, a frame period, an operational degradation of the seventh and fifteenth TFTs T7 and T15 is reduced by one half.

The first TFT T1 discharges the Q1 node to the low potential voltage VSS based on the voltage of the QB2 node. A gate electrode of the first TFT T1 is connected to the QB2 node, a drain electrode of the first TFT T1 is connected to the Q1 node, and a source electrode of the first TFT T1 is connected to the input terminal of the low potential voltage VSS. The second TFT T2 discharges the Q1 node to the low potential voltage VSS based on the voltage of the QB1 node. A gate electrode of the second TFT T2 is connected to the QB1 node, a drain electrode of the second TFT T2 is connected to the Q1 node, and a source electrode of the second TFT T2 is connected to the input terminal of the low potential voltage VSS.

The ninth TFT T9 discharges the Q2 node to the low potential voltage VSS based on the voltage of the QB1 node. A gate electrode of the ninth TFT T9 is connected to the QB1 node, a drain electrode of the ninth TFT T9 is connected to the Q2 node, and a source electrode of the ninth TFT T9 is connected to the input terminal of the low potential voltage VSS. The tenth TFT T10 discharges the Q2 node to the low potential voltage VSS based on the voltage of the QB2 node. A gate electrode of the tenth TFT T10 is connected to the QB2 node, a drain electrode of the tenth TFT T10 is connected to the Q2 node, and a source electrode of the tenth TFT T10 is connected to the input terminal of the low potential voltage VSS.

The third TFT T3 is diode-connected and applies the odd AC driving voltage VDD_O to a first node N1. A gate electrode and a drain electrode of the third TFT T3 are connected to an input terminal of the odd AC driving voltage VDD_O, and a source electrode of the third TFT T3 is connected to the first node N1. The fourth TFT T4 switches on or off a current path between the first node N1 and the input terminal of the low potential voltage VSS based on the voltage of the Q1 node. A gate electrode of the fourth TFT T4 is connected to the Q1 node, a drain electrode of the fourth TFT T4 is connected to the first node N1, and a source electrode of the fourth TFT T4 is connected to the input terminal of the low potential voltage VSS. The fifth TFT T5 discharges the QB1 node to the low potential voltage VSS based on the voltage of the Q1 node. A gate electrode of the fifth TFT T5 is connected to the Q1 node, a drain electrode of the fifth TFT T5 is connected to the QB1 node, and a source electrode of the fifth TFT T5 is connected to the input terminal of the low potential voltage VSS. The sixth TFT T6 charges the QB1 node to the odd AC driving voltage VDD_O based on the voltage of the first node N1. A gate electrode of the sixth TFT T6 is connected to the first node N1, a drain electrode of the sixth TFT T6 is connected to the input terminal of the odd AC driving voltage VDD_O, and a source electrode of the sixth TFT T6 is connected to the QB1 node. The seventh TFT T7 discharges the QB1 node to the low potential voltage VSS based on the voltage of the second node N2. A gate electrode of the seventh TFT T7 is connected to the second node N2, a drain electrode of the seventh TFT T7 is connected to the QB1 node, and a source electrode of the seventh TFT T7 is connected to the input terminal of the low potential voltage VSS. The eighth TFT T8 switches on or off a current path between the first node N1 and the input terminal of the low potential voltage VSS based on the voltage of the Q2 node. A gate electrode of the eighth TFT T8 is connected to the Q2 node, a drain electrode of the eighth TFT T8 is connected to the first node N1, and a source electrode of the eighth TFT T8 is connected to the input terminal of the low potential voltage VSS. The eleventh TFT T11 is diode-connected and applies the even AC driving voltage VDD_E to a third node N3. A gate electrode and a drain electrode of the eleventh TFT T11 are connected to an input terminal of the even AC driving voltage VDD_E, and a source electrode of the eleventh TFT T11 is connected to the third node N3. The twelfth TFT T12 switches on or off a current path between the third node N3 and the input terminal of the low potential voltage VSS based on the voltage of the Q2 node. A gate electrode of the twelfth TFT T12 is connected to the Q2 node, a drain electrode of the twelfth TFT T12 is connected to the third node N3, and a source electrode of the twelfth TFT T12 is connected to the input terminal of the low potential voltage VSS. The thirteenth TFT T13 discharges the QB2 node to the low potential voltage VSS based on the voltage of the Q2 node. A gate electrode of the thirteenth TFT T13 is connected to the Q2 node, a drain electrode of the thirteenth TFT T13 is connected to the QB2 node, and a source electrode of the thirteenth TFT T13 is connected to the input terminal of the low potential voltage VSS. The fourteenth TFT T14 charges the QB2 node to the even AC driving voltage VDD_E based on the voltage of the third node N3. A gate electrode of the fourteenth TFT T14 is connected to the third node N3, a drain electrode of the fourteenth TFT T14 is connected to the input terminal of the even AC driving voltage VDD_E, and a source electrode of the fourteenth TFT T14 is connected to the QB2 node. The fifteenth TFT T15 discharges the QB2 node to the low potential voltage VSS based on the voltage of the second node N2. A gate electrode of the fifteenth TFT T15 is connected to the second node N2, a drain electrode of the fifteenth TFT T15 is connected to the QB2 node, and a source electrode of the fifteenth TFT T15 is connected to the input terminal of the low potential voltage VSS. The sixteenth TFT T16 switches on or off a current path between the third node N3 and the input terminal of the low potential voltage VSS based on the voltage of the Q1 node. A gate electrode of the sixteenth TFT T16 is connected to the Q1 node, a drain electrode of the sixteenth TFT T16 is connected to the third node N3, and a source electrode of the sixteenth TFT T16 is connected to the input terminal of the low potential voltage VSS.

The floating prevention unit 40 includes a first floating prevention TFT TH1 and a second floating prevention TFT TH2.

The first floating prevention TFT TH1 switches on or off a current path between the second node N2 and the input terminal of the low potential voltage VSS based on the voltage of the QB1 node. A gate electrode of the first floating prevention TFT TH1 is connected to the QB1 node, a drain electrode of the first floating prevention TFT TH1 is connected to the second node N2, and a source electrode of the first floating prevention TFT TH1 is connected to the input terminal of the low potential voltage VSS. The first floating prevention TFT TH1 is turned on during a period, in which the QB1 node is held at a charging level, thereby preventing a floating of the seventh TFT T7. Hence, the first floating prevention TFT TH1 discharges leakage charges accumulated at the second node N2 to the input terminal of the low potential voltage VSS, thereby preventing the degradation of the seventh TFT T7. As a result, the first floating prevention TFT TH1 prevents an abnormal turn-on operation of the seventh TFT T7 during the period, in which the QB1 node is held at the charging level, thereby providing a stable output.

The second floating prevention TFT TH2 switches on or off a current path between the second node N2 and the input terminal of the low potential voltage VSS based on the voltage of the QB2 node. A gate electrode of the second floating prevention TFT TH2 is connected to the QB2 node, a drain electrode of the second floating prevention TFT TH2 is connected to the second node N2, and a source electrode of the second floating prevention TFT TH2 is connected to the input terminal of the low potential voltage VSS. The second floating prevention TFT TH2 is turned on during a period, in which the QB2 node is held at a charging level, thereby preventing a floating of the fifteenth TFT T15. Hence, the second floating prevention TFT TH2 discharges leakage charges accumulated at the second node N2 to the input terminal of the low potential voltage VSS, thereby preventing the degradation of the fifteenth TFT T15. As a result, the second floating prevention TFT TH2 prevents an abnormal turn-on operation of the fifteenth TFT T15 during the period, in which the QB2 node is held at the charging level, thereby providing a stable output.

The output unit 50 includes a first output unit generating the first scan pulse Vout(k1) and a second output unit generating the second scan pulse Vout(k2).

The first output unit includes a first pull-up TFT TU1 that is turned on based on the voltage of the Q1 node and charges a first output node NO1 to the gate shift clock CLK A, a 1-1 pull-down TFT TD11 that is turned on based on the voltage of the QB1 node and discharges the first output node NO1 to the low potential voltage VSS, and a 1-2 pull-down TFT TD12 that is turned on based on the voltage of the QB2 node and discharges the first output node NO1 to the low potential voltage VSS. The first pull-up TFT TU1 is turned on due to a bootstrapping of the Q1 node, thereby charging the first output node NO1 to the gate shift clock CLK A and rising the first scan pulse Vout(k1). A gate electrode of the first pull-up TFT TU1 is connected to the Q1 node, a drain electrode of the first pull-up TFT TU1 is connected to an input terminal of the gate shift clock CLK A, and a source electrode of the first pull-up TFT TU1 is connected to the first output node NO1. The 1-1 pull-down TFT TD11 and the 1-2 pull-down TFT TD 12 discharge the first output node NO1 to the low potential voltage VSS based on the voltages of the QB1 node and the QB2 node, respectively, so that the first scan pulse Vout(k1) is held in a falling state. A gate electrode of the 1-1 pull-down TFT TD11 is connected to the QB1 node, a drain electrode of the 1-1 pull-down TFT TD11 is connected to the first output node NO1, and a source electrode of the 1-1 pull-down TFT TD 11 is connected to the input terminal of the low potential voltage VSS. A gate electrode of the 1-2 pull-down TFT TD 12 is connected to the QB2 node, a drain electrode of the 1-2 pull-down TFT TD 12 is connected to the first output node NO1, and a source electrode of the 1-2 pull-down TFT TD12 is connected to the input terminal of the low potential voltage VSS. The first scan pulse Vout(k1) is supplied to the corresponding scan line through a first output channel CHL Further, the first scan pulse Vout(k1) is supplied to a fourth input terminal VNT2 of the (k−2)th stage STG(k−2) and a second input terminal VST2 of the (k+1)th stage STG(k+1), so as to serve as a carry signal.

The second output unit includes a second pull-up TFT TU2 that is turned on based on the voltage of the Q2 node and charges a second output node NO2 to the gate shift clock CLK B, a 2-1 pull-down TFT TD21 that is turned on based on the voltage of the QB1 node and discharges the second output node NO2 to the low potential voltage VSS, and a 2-2 pull-down TFT TD22 that is turned on based on the voltage of the QB2 node and discharges the second output node NO2 to the low potential voltage VSS. The second pull-up TFT TU2 is turned on due to a bootstrapping of the Q2 node, thereby charging the second output node NO2 to the gate shift clock CLK B and rising the second scan pulse Vout(k2). A gate electrode of the second pull-up TFT TU2 is connected to the Q2 node, a drain electrode of the second pull-up TFT TU2 is connected to an input terminal of the gate shift clock CLK B, and a source electrode of the second pull-up TFT TU2 is connected to the second output node NO2. The 2-1 pull-down TFT TD21 and the 2-2 pull-down TFT TD22 discharge the second output node NO2 to the low potential voltage VSS based on the voltages of the QB1 node and the QB2 node, respectively, so that the second scan pulse Vout(k2) is held in a falling state. A gate electrode of the 2-1 pull-down TFT TD21 is connected to the QB1 node, a drain electrode of the 2-1 pull-down TFT TD21 is connected to the second output node NO2, and a source electrode of the 2-1 pull-down TFT TD21 is connected to the input terminal of the low potential voltage VSS. A gate electrode of the 2-2 pull-down TFT TD22 is connected to the QB2 node, a drain electrode of the 2-2 pull-down TFT TD22 is connected to the second output node NO2, and a source electrode of the 2-2 pull-down TFT TD22 is connected to the input terminal of the low potential voltage VSS. The second scan pulse Vout(k2) is supplied to the corresponding scan line through a second output channel CH2. Further, the second scan pulse Vout(k2) is supplied to a third input terminal VNT1 of the (k−1)th stage STG(k−1) and a first input terminal VST1 of the (k+2)th stage STG(k+2), so as to serve as a carry signal.

FIG. 3 illustrates input and output signals of the k-th stage during a forward shift operation. The forward shift operation of the k-th stage is sequentially described with reference to FIGS. 2 and 3.

As shown in FIGS. 2 and 3, in a forward shift mode, a forward gate start pulse (not shown) is generated, and the 6-phase gate shift clocks CLK1 to CLK6 are generated as cycle clocks that are sequentially delayed in order from the first gate shift clock CLK1 to the sixth gate shift clock CLK6. In the forward shift mode, the forward driving voltage VDD_F of the same level as the gate high voltage VGH is input, and the reverse driving voltage VDD_R of the same level as the gate low voltage VGL is input. In the forward shift mode, it is assumed that the gate shift clocks CLK A and CLK B input to the k-th stage STG(k) are the gate shift clocks CLK1 and CLK2, respectively.

First, in the forward shift mode, an operation of the k-th stage STG(k) during an odd frame is described. The odd frame may include a frame arranged in each of odd-numbered positions and a frame group that includes a plurality of adjacent frames and is arranged in an odd-numbered position. During the odd frame, the odd AC driving voltage VDD_O of the same level as the gate high voltage VGH is input, and the even AC driving voltage VDD_E of the same level as the gate low voltage VGL is input. Further, the QB2 node is continuously held at the level of the gate low voltage VGL. Thus, the TFTs T1, T10, TD12, and TD22 whose the gate electrodes are connected to the QB2 node are continuously held in a turn-off state, i.e., a pause driving state. In FIG. 3, 'VQ1' indicates a voltage of the Q1 node, 'VQ2' indicates a voltage of the Q2 node, 'VQB1' indicates a voltage of the QB1 node, and 'VQB2' indicates a voltage of the QB2 node.

During periods T1 and T2, the second carry signal Vout(k−2)2 of the (k−2)th stage STG(k−2) is input through the first input terminal VST1 as a start signal. The first and third forward TFTs TF1 and TF3 are turned on in response to the start signal. As a result, the Q1 node is charged to the gate high voltage VGH, and the QB1 node is discharged to the gate low voltage VGL.

During periods T2 and T3, the first carry signal Vout(k−1)1 of the (k−1)th stage STG(k−1) is input through the second input terminal VST2 as a start signal. The second forward TFT TF2 is turned on in response to the start signal. As a result, the Q2 node is charged to the gate high voltage VGH.

During periods T3 and T4, the first gate shift clock CLK1 is applied to the drain electrode of the first pull-up TFT TU1. The voltage of the Q1 node is bootstrapped because of a parasitic capacitance between the gate electrode and the drain electrode of the first pull-up TFT TU1 and increases to a voltage level VGH' higher than the gate high voltage VGH, thereby allowing the first pull-up TFT TU1 to be turned on. Thus, during the periods T3 and T4, the voltage of the first output node NO1 increases to the gate high voltage VGH and rises the first scan pulse Vout(k1).

During periods T4 and T5, the second gate shift clock CLK2 is applied to the drain electrode of the second pull-up TFT TU2. The voltage of the Q2 node is bootstrapped because of a parasitic capacitance between the gate electrode and the drain electrode of the second pull-up TFT TU2 and increases to the voltage level VGH' higher than the gate high voltage VGH, thereby allowing the second pull-up TFT TU2 to be turned on. Thus, during the periods T4 and T5, the voltage of the second output node NO2 increases to the gate high voltage VGH and rises the second scan pulse Vout(k2).

During the period T5, the second carry signal Vout(k+1)2 of the (k+1)th stage STG(k+1) is input through the third input terminal VNT1 as a reset signal. The first reverse TFT TR1 is turned on in response to the reset signal. As a result, the Q1 node is discharged to the gate low voltage VGL. The first pull-up TFT TU 1 is turned off due to the discharge of the Q1 node. Even if the fourth TFT T4 is turned off due to the discharge of the Q1 node, the QB1 node is held to the gate low voltage VGL because of the turn-on operation of the eighth TFT T8. During the period T5, the first scan pulse Vout(k1) falls to the gate low voltage VGL.

During a period T6, the first carry signal Vout(k+2)1 of the (k+2)th stage STG(k+2) is input through the fourth input terminal VNT2 as a reset signal. The second reverse TFT TR2 is turned on in response to the reset signal. As a result, the Q2 node is discharged to the gate low voltage VGL. The second pull-up TFT TU2 is turned off due to the discharge of the Q2 node. Because the eighth TFT T8 is turned off due to the discharge of the Q2 node, the QB1 node is charged to the odd AC driving voltage VDD_O of the same level as the gate high voltage VGH applied through the sixth TFT T6. The first and second pull-down TFTs TD11 and TD21 are turned on due to the charging of the QB1 node. Hence, the voltage of the first output node NO1 decreases to the gate low voltage VGL and holds the first scan pulse Vout(k1) in a falling state. The voltage of the second output node NO2 decreases to the gate low voltage VGL and falls the second scan pulse Vout(k2). Further, the first floating prevention TFT TH1 is turned on due to the charging of the QB1 node and continuously applies the gate low voltage VGL to the second node N2, thereby preventing the degradation and the abnormal operation of the seventh TFT T7.

Next, in the forward shift mode, an operation of the k-th stage STG(k) during an even frame is described. The even frame may include a frame arranged in each of even-numbered positions and a frame group that includes a plurality of adjacent frames and is arranged in an even-numbered position. During the even frame, the even AC driving voltage VDD_E of the same level as the gate high voltage VGH is input, and the odd AC driving voltage VDD_O of the same level as the gate low voltage VGL is input. Further, the QB1 node is continuously held at the level of the gate low voltage VGL. Thus, the TFTs T2, T9, TD11, and TD21 whose the gate electrodes are connected to the QB1 node are continuously held in a turn-off state, i.e., a pause driving state. The operation of the k-th stage STG(k) during the even frame is substantially the same as the operation of the k-th stage STG(k) during the odd frame in the generation timing of the first and second scan pulses Vout(k1) and Vout(k2), except that the voltages of the first and second output nodes NO1 and NO2 are controlled by the QB2 node and the second floating prevention TFT TH2 operates during the even frame. Thus, the detailed description of the operation of the k-th stage STG(k) during the even frame is omitted.

FIG. 4 illustrates input and output signals of the k-th stage during a reverse shift operation. The reverse shift operation of the k-th stage is sequentially described with reference to FIGS. 2 and 4.

As shown in FIGS. 2 and 4, in a reverse shift mode, a reverse gate start pulse (not shown) is generated, and the 6-phase gate shift clocks CLK1 to CLK6 are generated as cycle clocks that are sequentially delayed in order from the sixth gate shift clock CLK6 to the first gate shift clock CLK1. In the reverse shift mode, the reverse driving voltage VDD_R of the same level as the gate high voltage VGH is input, and the forward driving voltage VDD_F of the same level as the gate low voltage VGL is input. In the reverse shift mode, it is assumed that the gate shift clocks CLK A and CLK B input to the k-th stage STG(k) are the gate shift clocks CLK5 and CLK6, respectively.

First, in the reverse shift mode, an operation of the k-th stage STG(k) during an odd frame is described. The odd frame may include a frame arranged in each of odd-numbered positions and a frame group that includes a plurality of adjacent frames and is arranged in an odd-numbered position. During the odd frame, the odd AC driving voltage VDD_O of the same level as the gate high voltage VGH is input, and the even AC driving voltage VDD_E of the same level as the gate low voltage VGL is input. Further, the QB2 node is continuously held at the level of the gate low voltage VGL. Thus, the TFTs T1, T10, TD12, and TD22 whose the gate electrodes are connected to the QB2 node are continuously held in a turn-off state, i.e., a pause driving state. In FIG. 3, 'VQ1' indicates the voltage of the Q1 node, 'VQ2' indicates the voltage of the Q2 node, 'VQB1' indicates the voltage of the QB1 node, and 'VQB2' indicates the voltage of the QB2 node.

During the periods T1 and T2, the first carry signal Vout (k+2)1 of the (k+2)th stage STG(k+2) is input through the fourth input terminal VNT2 as a start signal. The second and third reverse TFTs TR2 and TR3 are turned on in response to the start signal. As a result, the Q2 node is charged to the gate high voltage VGH, and the QB1 node is discharged to the gate low voltage VGL.

During the periods T2 and T3, the second carry signal Vout(k+1)2 of the (k+1)th stage STG(k+1) is input through the third input terminal VNT1 as a start signal. The first reverse TFT TR1 is turned on in response to the start signal. As a result, the Q1 node is charged to the gate high voltage VGH.

During the periods T3 and T4, the sixth gate shift clock CLK6 is applied to the drain electrode of the second pull-up TFT TU2. The voltage of the Q2 node is bootstrapped because of a parasitic capacitance between the gate electrode and the drain electrode of the second pull-up TFT TU2 and increases to the voltage level VGH' higher than the gate high voltage VGH, thereby allowing the second pull-up TFT TU2 to be turned on. Thus, during the periods T3 and T4, the voltage of the second output node NO2 increases to the gate high voltage VGH and rises the second scan pulse Vout(k2).

During the periods T4 and T5, the fifth gate shift clock CLK5 is applied to the drain electrode of the first pull-up TFT TU1. The voltage of the Q1 node is bootstrapped because of a parasitic capacitance between the gate electrode and the drain electrode of the first pull-up TFT TU1 and increases to the voltage level VGH' higher than the gate high voltage VGH, thereby allowing the first pull-up TFT TU1 to be turned on. Thus, during the periods T4 and T5, the voltage of the first output node NO1 increases to the gate high voltage VGH and rises the first scan pulse Vout(k1).

During the period T5, the first carry signal Vout(k−1)1 of the (k−1)th stage STG(k−1) is input through the second input terminal VST2 as a reset signal. The second forward TFT TF2 is turned on in response to the reset signal. As a result, the Q2 node is discharged to the gate low voltage VGL. The second pull-up TFT TU2 is turned off due to the discharge of the Q2 node. During the period T5, the QB1 node is held to the gate low voltage VGL because of the turn-on operation of the fourth TFT T4, and the second scan pulse Vout(k2) falls to the gate low voltage VGL.

During the period T6, the second carry signal Vout(k−2)2 of the (k−2)th stage STG(k−2) is input through the first input terminal VST1 as a reset signal. The first forward TFT TF1 is turned on in response to the reset signal. As a result, the Q1 node is discharged to the gate low voltage VGL. The first pull-up TFT TU1 is turned off due to the discharge of the Q1 node. Because the fourth TFT T4 is turned off due to the discharge of the Q1 node, the QB1 node is charged to the odd AC driving voltage VDD_O of the same level as the gate high voltage VGH applied through the sixth TFT T6. The first and second pull-down TFTs TD11 and TD21 are turned on due to the charging of the QB1 node. Hence, the voltage of the second output node NO2 decreases to the gate low voltage VGL and holds the second scan pulse Vout(k2) in a falling state. The voltage of the first output node NO1 decreases to the gate low voltage VGL and falls the first scan pulse Vout (k1). Further, the first floating prevention TFT TH1 is turned on due to the charging of the QB1 node and continuously applies the gate low voltage VGL to the second node N2, thereby preventing the degradation and the abnormal operation of the seventh TFT T7.

Next, in the reverse shift mode, an operation of the k-th stage STG(k) during an even frame is described. The even frame may include a frame arranged in each of even-numbered positions and a frame group that includes a plurality of adjacent frames and is arranged in an even-numbered position. During the even frame, the even AC driving voltage VDD_E of the same level as the gate high voltage VGH is input, and the odd AC driving voltage VDD_O of the same level as the gate low voltage VGL is input. Further, the QB1 node is continuously held at the level of the gate low voltage VGL. Thus, the TFTs T2, T9, TD11, and TD21 whose the gate electrodes are connected to the QB1 node are continuously held in a turn-off state, i.e., a pause driving state. The operation of the k-th stage STG(k) during the even frame is substantially the same as the operation of the k-th stage STG(k) during the odd frame in the generation timing of the first and second scan pulses Vout(k1) and Vout(k2), except that the voltages of the first and second output nodes NO1 and NO2 are controlled by the QB2 node and the second floating prevention TFT TH2 operates during the even frame. Thus, the detailed description of the operation of the k-th stage STG(k) during the even frame is omitted.

Figure 5:
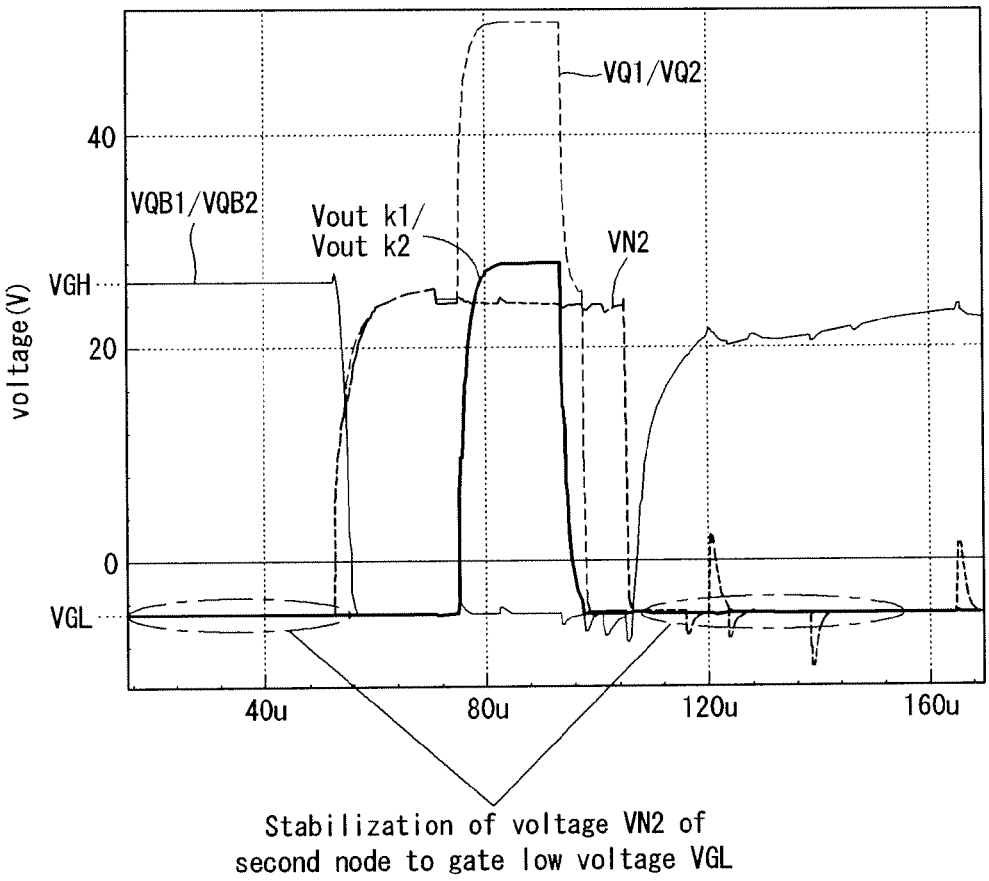
FIG. 5 illustrates a simulation result in which a voltage of a second node shown in FIG. 2 is held to a gate low voltage.

FIG. 5 illustrates a simulation result in which the voltage of the second node shown in FIG. 2 is held at the gate low voltage.

As shown in FIGS. 2 and 5, a voltage VN2 of the second node N2 is stably held to the gate low voltage VGL by the floating prevention unit 40 during a period in which the QB1 node or the QB2 node is held to the gate high voltage VGH. As a result, because a gate-bias stress is slightly given to the discharge TFTs T7 and T15 that are connected to the second node N2 and discharge the QB1 node or the QB2 node, a degradation speed of the discharge TFTs T7 and T15 becomes slow. Further, because an abnormal turn-on operation of the discharge TFTs T7 and T15 is prevented, the scan pulse of the discharge TFTs T7 and T15 is stably output.

Figure 6:
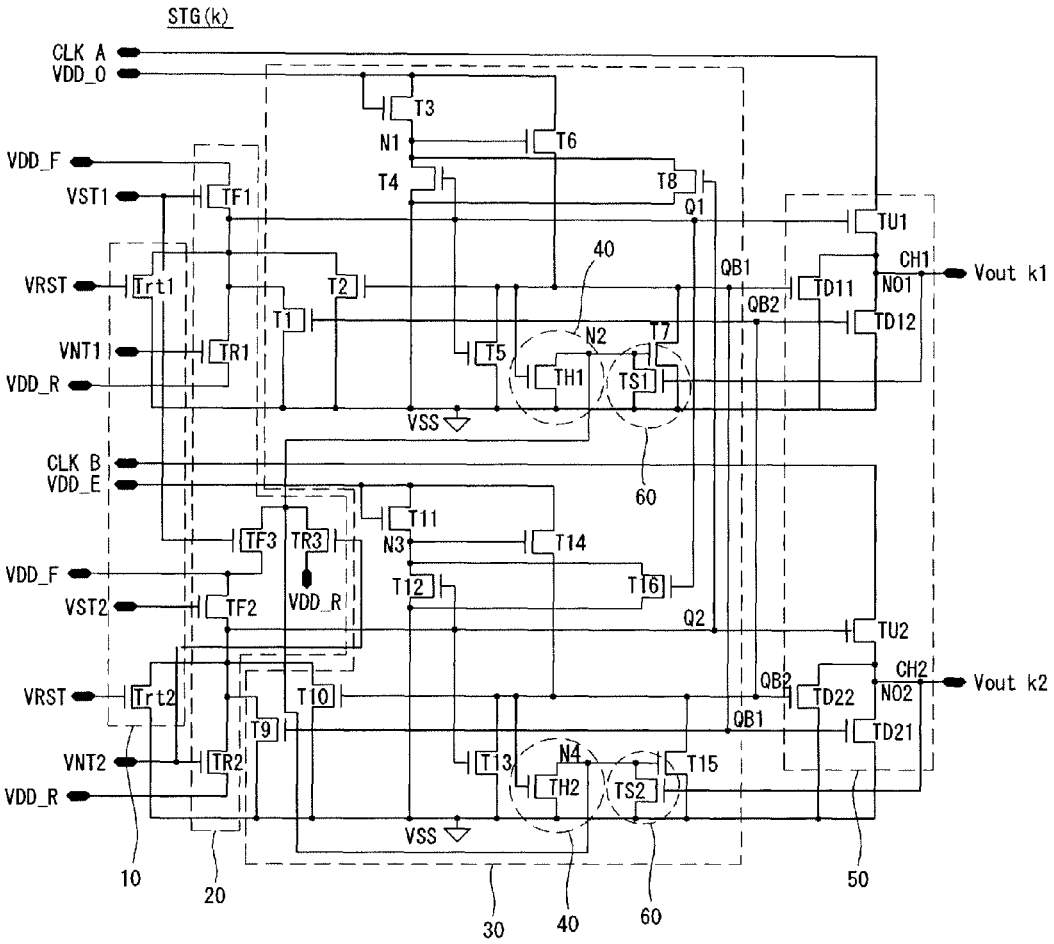
FIG. 6 illustrates another exemplary circuit configuration of a k-th stage.
Figure 7:
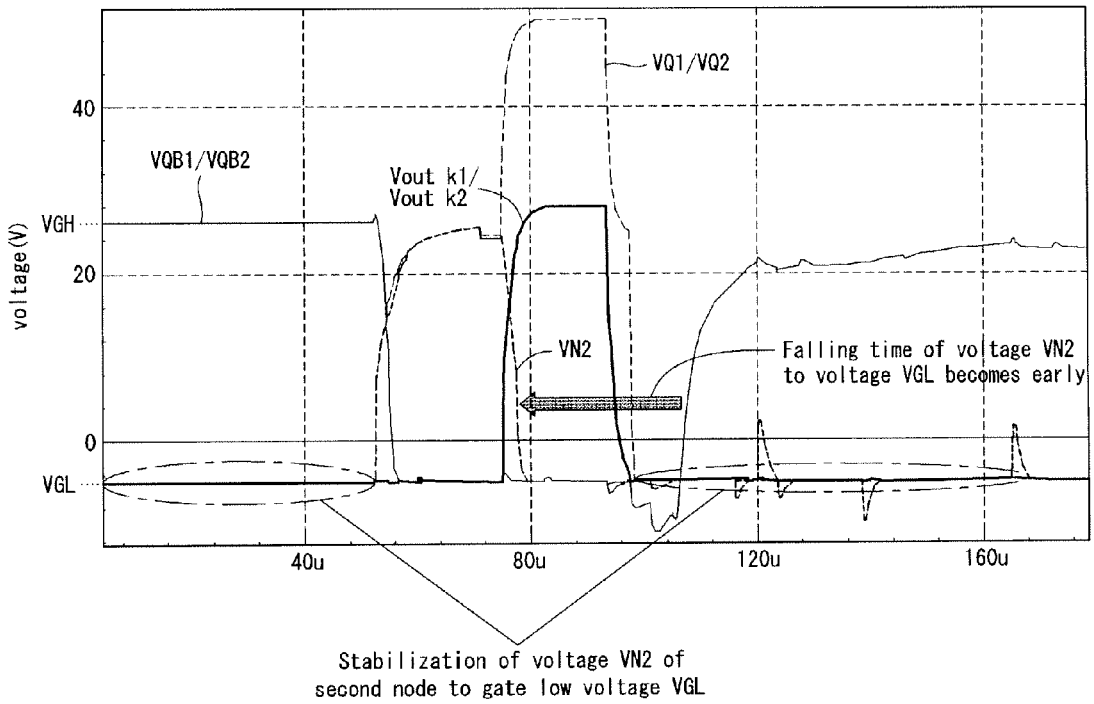
FIG. 7 illustrates a simulation result in which a voltage of a second node shown in FIG. 6 is held to a gate low voltage.

FIG. 6 illustrates another exemplary circuit configuration of the k-th stage. FIG. 7 illustrates a simulation result in which a voltage of a second node shown in FIG. 6 is held to the gate low voltage.

The k-th stage STG(k) shown in FIG. 6 further includes a degradation prevention strengthening unit 60, unlike the k-th stage STG(k) shown in FIG. 2. The degradation prevention strengthening unit 60 includes a first strengthening TFT TS1 and a second strengthening TFT TS2.

The first strengthening TFT TS1 switches on or off a current path between the second node N2 and the input terminal of the low potential voltage VSS based on the voltage of the first output node NO1. A gate electrode of the first strengthening TFT TS1 is connected to the first output node NO1, a drain electrode of the first strengthening TFT TS1 is connected to the second node N2, and a source electrode of the first strengthening TFT TS1 is connected to the input terminal of the low potential voltage VSS. The first strengthening TFT TS1 is turned on from a time when the scan pulse Vout(k1)/Vout(k2) rises to the gate high voltage VGH prior to a period during which the QB1 node is held to the gate high voltage VGH, thereby preventing the floating of the seventh TFT T7. Hence, the first strengthening TFT TS1 discharges leakage charges accumulated at the second node N2 to the input terminal of the low potential voltage VSS.

The second strengthening TFT TS2 switches on or off a current path between the second node N2 and the input terminal of the low potential voltage VSS based on the voltage of the second output node NO2. A gate electrode of the second strengthening TFT TS2 is connected to the second output node NO2, a drain electrode of the second strengthening TFT TS2 is connected to the second node N2, and a source electrode of the second strengthening TFT TS2 is connected to the input terminal of the low potential voltage VSS. The second strengthening TFT TS2 is turned on from a time when the scan pulse Vout(k1)/Vout(k2) rises to the gate high voltage VGH prior to a period during which the QB2 node is held to the gate high voltage VGH, thereby preventing the floating of the fifteenth TFT T15. Hence, the second strengthening TFT TS2 discharges leakage charges accumulated at the second node N2 to the input terminal of the low potential voltage VSS.

As shown in FIG. 7, a time when the voltage VN2 of the second node N2 falls to the gate low voltage VGL is earlier than a time in the circuit of the k-th stage STG(k) shown in FIG. 2 due to the operation of the degradation prevention strengthening unit 60. In other words, the degradation prevention strengthening unit 60 holds longer the voltage VN2 of the second node N2 to the gate low voltage VGL. As a result, because the gate-bias stress is slightly given to the discharge TFTs T7 and T15 that are connected to the second node N2 and discharge the QB1 node or the QB2 node, the degradation speed of the discharge TFTs T7 and T15 becomes slow.

Figure 8:
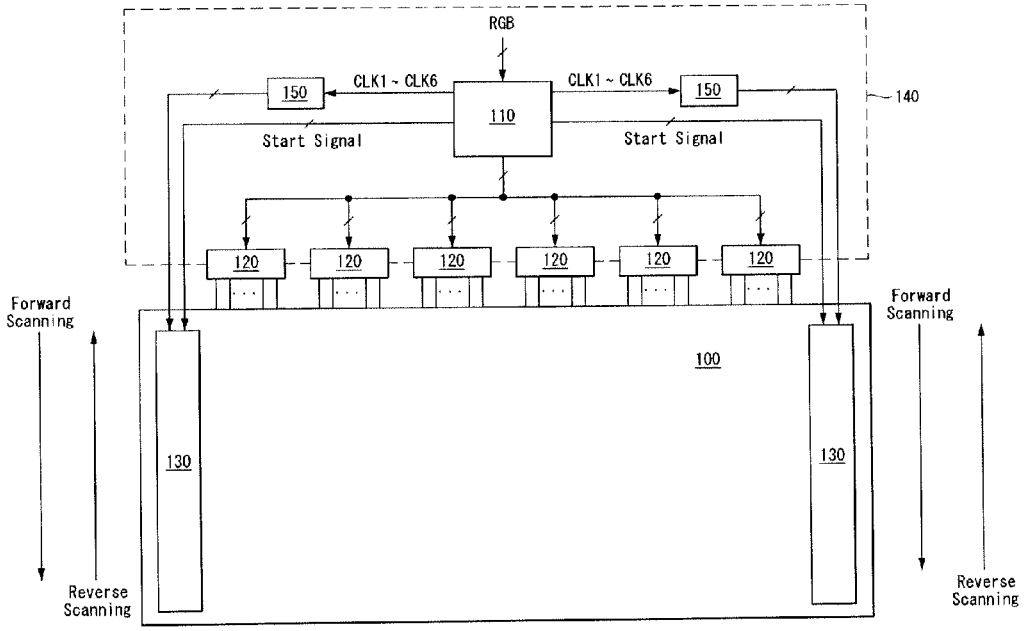
FIG. 8 is a block diagram schematically illustrating a display device according to an exemplary embodiment of the invention.

FIG. 8 is a block diagram schematically illustrating a display device according to an exemplary embodiment of the invention. As shown in FIG. 8, a display device according to an exemplary embodiment of the invention includes a display panel 100, a data driving circuit, a scan driving circuit, and a timing controller 110.

The display panel 100 includes data lines and scan lines crossing each other and a plurality of pixels arranged in a matrix form. The display panel 100 may be implemented as one of a liquid crystal display (LCD), an organic light emitting diode (OLED) display, and an electrophoresis display (EPD).

The data driving circuit includes a plurality of source driver integrated circuits (ICs) 120. Each of the source driver ICs receives digital video data RGB from the timing controller 110. Each of the source driver ICs converts the digital video data RGB into a gamma compensation voltage in response to a source timing control signal received from the timing controller 110 and generates a data voltage. Each of the source driver ICs then supplies the data voltage to the data lines of the display panel 100, so that the data voltage is synchronized with the scan pulse. Each of the source driver ICs may be connected to the data lines of the display panel 100 through a chip-on-glass (COG) process or a tape automated bonding (TAB) process.

The scan driving circuit includes a level shifter 150 connected between the timing controller 110 and the scan lines of the display panel 100 and a gate shift register 130.

Figure 9:
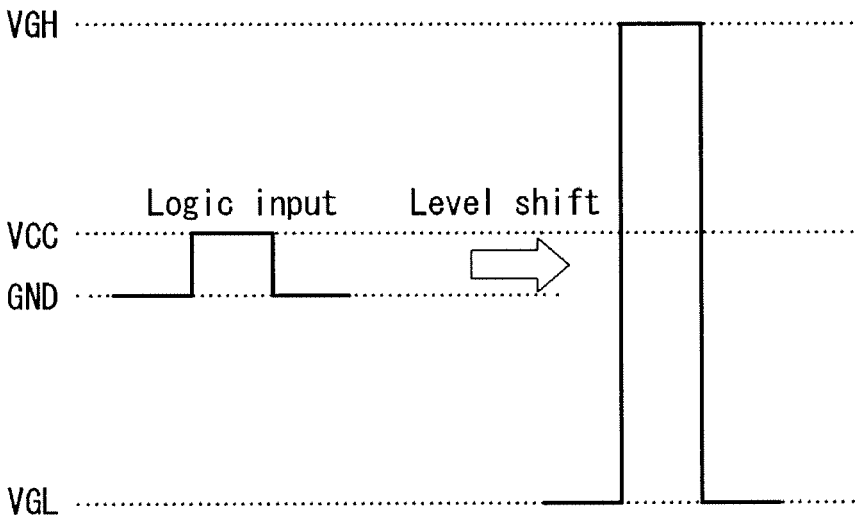
FIG. 9 is a waveform diagram illustrating input and output signals of a level shifter shown in FIG. 8.

As shown in FIG. 9, the level shifter 150 level-shifts a transistor-transistor logic (TTL) level voltage of the 6-phase gate shift clocks CLK1 to CLK6 received from the timing controller 110 to the gate high voltage VGH and the gate low voltage VGL.

As described above, the gate shift register 130 includes the plurality of stages that shift a gate start pulse VST in conformity with the gate shift clocks CLK1 to CLK6 and sequentially output a carry signal Cout and a scan pulse Gout.

The scan driving circuit may be directly formed on a lower glass substrate of the display panel 100 through a gate-in-panel (GIP) process or may be connected between the timing controller 110 and the gate lines of the display panel 100 through the TAB process. In the GIP process, the level shifter 150 may be mounted on a printed circuit board (PCB) 140, and the gate shift register 130 may be mounted on the lower glass substrate of the display panel 100.

The timing controller 110 receives the digital video data RGB from an external host computer through an interface, such as a low voltage differential signaling (LVDS) interface and a transition minimized differential signaling (TMDS) interface. The timing controller 110 transmits the digital video data RGB received from the external host computer to the source driver ICs 120.

The timing controller 110 receives a timing signal, such as a vertical sync signal Vsync, a horizontal sync signal Hsync, a data enable DE, and a main clock MCLK, from the host computer through a LVDS or TMDS interface receiving circuit. The timing controller 110 generate timing control signals for controlling operation timings of the data driving circuit and the scan driving circuit based on the timing signal received from the host computer. The timing control signals include a scan timing control signal for controlling the operation timing of the scan driving circuit and a data timing control signal for controlling the operation timing of the source driver ICs 120 and a polarity of the data voltage.

The scan timing control signal includes a gate start pulse (not shown), the gate shift clocks CLK1 to CLK6, a gate output enable (not shown), and the like. The gate start pulse includes the forward gate start pulse and the reverse gate start pulse. The gate start pulse is input to the gate shift register 130 and controls a shift start time. The gate shift clocks CLK1 to CLK6 are level-shifted through the level shifter 150 and then are input to the gate shift register 130. The gate shift clocks CLK1 to CLK6 are used as a clock for shifting the gate start pulse. The gate output enable controls an output time of the gate shift register 130.

The data timing control signal includes a source start pulse, a source sampling clock, a source output enable, and a polarity control signal, and the like. The source start pulse controls a shift start time of the source driver ICs 120. The source sampling clock controls a sampling time of data inside the source driver ICs 120 based on a rising or falling edge. The polarity control signal controls a polarity of the data voltage output from the source driver ICs 120. If a data transfer interface between the timing controller 110 and the source driver ICs 120 is a mini LVDS interface, the source start pulse and the source sampling clock may be omitted.

As described above, in the gate shift register and the display device using the same according to the exemplary embodiments of the invention, because the floating prevention unit or the degradation prevention strengthening unit is connected to the gate electrode of the discharge TFT, that is connected between the QB1 or QB2 node and the input terminal of the low potential voltage in each stage of the gate shift register and operates in response to the shift direction conversion signal, the floating and the degradation of the discharge TFT are prevented. Furthermore, the outputs of the stages can be stabilized.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gate shift register comprising:

a plurality of stages configured to receive a plurality of gate shift clocks and sequentially output a scan pulse, wherein a k-th stage of the plurality of stages includes:

a scan direction controller configured to convert a shift direction of the scan pulse in response to carry signals of previous stages input through first and second input terminals and carry signals of next stages input through third and fourth input terminals;

a node controller configured to control charging and discharge operations of each of a Q1 node, a Q2 node, a QB1 node, and a QB2 node, the node controller including a discharge thin film transistor (TFT) configured to discharge the QB1 node or the QB2 node to a low potential voltage in response to a shift direction conversion signal;

a floating prevention unit configured to apply the low potential voltage to a gate electrode of the discharge TFT based on a high potential voltage of the QB1 node or the QB2 node;

a degradation prevention strengthening unit configured to apply the low potential voltage to the gate electrode of the discharge TFT based on a high potential voltage of the first output node or the second output node while the QB1 node or the QB2 node maintains the low potential voltage in order to elongate a period of the low potential voltage of the gate electrode of the discharge TFT, wherein a time when a voltage of the first output node or the second output node rises to the high potential voltage is prior to a time when the discharged QB1 node or the QB2 node is charged to the high potential voltage; and an output unit configured to output a first scan pulse through a first output node and a second scan pulse through a second output node based on voltages of the Q1, Q2, QB1, and QB2 nodes, wherein the voltage of the Q1 node controls a first pull-up transistor for charging the first output node, the voltage of the Q2 node controls a second pull-up transistor for charging the second output node, and the voltages of the QB1 and QB2 nodes control first and second pull-down transistors for discharging the first output node and control third and fourth pull-down transistors for discharging the second output node.

2. The gate shift register of claim 1, wherein the discharge TFT includes a first discharge TFT connected between the QB1 node and an input terminal of the low potential voltage and a second discharge TFT connected between the QB2 node and the input terminal of the low potential voltage, wherein the floating prevention unit includes:

a first floating prevention TFT configured to switch on or off a current path between a gate electrode of the first discharge TFT and the input terminal of the low potential voltage based on the voltage of the QB1 node; and a second floating prevention TFT configured to switch on or off a current path between a gate electrode of the second discharge TFT and the input terminal of the low potential voltage based on the voltage of the QB2 node.

3. The gate shift register of claim 2, wherein the degradation prevention strengthening unit includes:

a first strengthening TFT configured to switch on or off a current path between the gate electrode of the first discharge TFT and the input terminal of the low potential voltage based on the voltage of the first output node; and a second strengthening TFT configured to switch on or off a current path between the gate electrode of the second discharge TFT and the input terminal of the low potential voltage based on the voltage of the second output node.

4. The gate shift register of claim 2, wherein the QB1 node is charged and discharged reverse to the Q1 and Q2 nodes during an odd frame and is held in a discharge state during an even frame, wherein the QB2 node is charged and discharged reverse to the Q1 and Q2 nodes during the even frame and is held in a discharge state during the odd frame.

5. The gate shift register of claim 1, wherein each of the plurality of gate shift clocks has a pulse width of three horizontal periods and is generated as a 6-phase cycle clock whose a phase is shifted every one horizontal period, wherein adjacent gate shift clocks of the plurality of gate shift clocks overlap each other during two horizontal periods.

6. The gate shift register of claim 5, wherein the first scan pulse is supplied to a first scan line, and at the same time, serves as a first carry signal, wherein the second scan pulse is supplied to a second scan line, and at the same time, serves as a second carry signal, wherein the first input terminal is connected to a second output node of a (k−2)th stage, the second input terminal is connected to a first output node of a (k−1)th stage, the third input terminal is connected to a second output node of a (k+1)th stage, and the fourth input terminal is connected to a first output node of a (k+2)th stage.

7. The gate shift register of claim 6, wherein the scan direction controller includes:

a first forward TFT configured to apply a forward driving voltage to the Q1 node in response to a second carry signal of the (k−2)th stage input through the first input terminal;

a second forward TFT configured to apply the forward driving voltage to the Q2 node in response to a first carry signal of the (k−1)th stage input through the second input terminal;

a third forward TFT configured to apply the forward driving voltage to the gate electrode of the discharge TFT as the shift direction conversion signal in response to the second carry signal of the (k−2)th stage input through the first input terminal;

a first reverse TFT configured to apply a reverse driving voltage to the Q1 node in response to a second carry signal of the (k+1)th stage input through the third input terminal;

a second reverse TFT configured to apply the reverse driving voltage to the Q2 node in response to a first carry signal of the (k+2)th stage input through the fourth input terminal; and a third reverse TFT configured to apply the reverse driving voltage to the gate electrode of the discharge TFT as the shift direction conversion signal in response to the first carry signal of the (k+2)th stage input through the fourth input terminal.

8. The gate shift register of claim 7, wherein in a forward shift mode in which the second scan pulse is generated following the first scan pulse, carry signals input to the first and second input terminals serve as a start signal indicating a charging time of the Q1 node or the Q2 node, and carry signals input to the third and fourth input terminals serve as a reset signal indicating a discharge time of the Q1 node or the Q2 node, wherein in a reverse shift mode in which the first scan pulse is generated following the second scan pulse, carry signals input to the third and fourth input terminals serve as a start signal indicating a charging time of the Q1 node or the Q2 node, and carry signals input to the first and second input terminals serve as a reset signal indicating a discharge time of the Q1 node or the Q2 node.

9. A display device comprising:

a display panel including data lines and scan lines crossing each other and a plurality of pixels arranged in a matrix form;

a data driving circuit configured to supply a data voltage to the data lines; and a scan driving circuit configured to sequentially supply a scan pulse to the scan lines, the scan driving circuit including a plurality of stages that receive a plurality of gate shift clocks, whose phases are sequentially shifted, and are cascade-connected to one another, wherein a k-th stage of the plurality of stages includes:

a scan direction controller configured to convert a shift direction of the scan pulse in response to carry signals of previous stages input through first and second input terminals and carry signals of next stages input through third and fourth input terminals;

a node controller configured to control charging and discharge operations of each of a Q1 node, a Q2 node, a QB1 node, and a QB2 node, the node controller including a discharge thin film transistor (TFT) configured to discharge the QB1 node or the QB2 node to a low potential voltage in response to a shift direction conversion signal;

a floating prevention unit configured to apply the low potential voltage to a gate electrode of the discharge TFT based on a high potential voltage of the QB1 node or the QB2 node;

a degradation prevention strengthening unit configured to apply the low potential voltage to the gate electrode of the discharge TFT based on a high potential voltage of the first output node or the second output node while the QB1 node or the QB2 node maintains the low potential voltage in order to elongate a period of the low potential voltage of the gate electrode of the discharge TFT, wherein a time when a voltage of the first output node or the second output node rises to the high potential voltage is prior to a time when the discharged QB1 node or the QB2 node is charged to the high potential voltage; and an output unit configured to output a first scan pulse through a first output node and a second scan pulse through a second output node based on voltages of the Q1, Q2, QB1, and QB2 nodes, wherein the voltage of the Q1 node controls a first pull-up transistor for charging the first output node, the voltage of the Q2 node controls a second pull-up transistor for charging the second output node, and the voltages of the QB1 and QB2 nodes control first and second pull-down transistors for discharging the first output node and control third and fourth pull-down transistors for discharging the second output node.

10. The display device of claim 9, wherein the discharge TFT includes a first discharge TFT connected between the QB1 node and an input terminal of the low potential voltage and a second discharge TFT connected between the QB2 node and the input terminal of the low potential voltage, wherein the floating prevention unit includes:

a first floating prevention TFT configured to switch on or off a current path between a gate electrode of the first discharge TFT and the input terminal of the low potential voltage based on the voltage of the QB1 node; and a second floating prevention TFT configured to switch on or off a current path between a gate electrode of the second discharge TFT and the input terminal of the low potential voltage based on the voltage of the QB2 node.

11. The display device of claim 10, wherein the degradation prevention strengthening unit includes:

a first strengthening TFT configured to switch on or off a current path between the gate electrode of the first discharge TFT and the input terminal of the low potential voltage based on the voltage of the first output node; and a second strengthening TFT configured to switch on or off a current path between the gate electrode of the second discharge TFT and the input terminal of the low potential voltage based on the voltage of the second output node.

12. The display device of claim 10, wherein the QB1 node is charged and discharged reverse to the Q1 and Q2 nodes during an odd frame and is held in a discharge state during an even frame, wherein the QB2 node is charged and discharged reverse to the Q1 and Q2 nodes during the even frame and is held in a discharge state during the odd frame.

13. The display device of claim 9, wherein each of the plurality of gate shift clocks has a pulse width of three horizontal periods and is generated as a 6-phase cycle clock whose a phase is shifted every one horizontal period, wherein adjacent gate shift clocks of the plurality of gate shift clocks overlap each other during two horizontal periods.

14. The display device of claim 13, wherein the first scan pulse is supplied to a first scan line, and at the same time, serves as a first carry signal, wherein the second scan pulse is supplied to a second scan line, and at the same time, serves as a second carry signal, wherein the first input terminal is connected to a second output node of a (k−2)th stage, the second input terminal is connected to a first output node of a (k−1)th stage, the third input terminal is connected to a second output node of a (k+1)th stage, and the fourth input terminal is connected to a first output node of a (k+2)th stage.

15. The display device of claim 14, wherein the scan direction controller includes:

a first forward TFT configured to apply a forward driving voltage to the Q1 node in response to a second carry signal of the (k−2)th stage input through the first input terminal;

a second forward TFT configured to apply the forward driving voltage to the Q2 node in response to a first carry signal of the (k−1)th stage input through the second input terminal;

a third forward TFT configured to apply the forward driving voltage to the gate electrode of the discharge TFT as the shift direction conversion signal in response to the second carry signal of the (k−2)th stage input through the first input terminal;

a first reverse TFT configured to apply a reverse driving voltage to the Q1 node in response to a second carry signal of the (k+1)th stage input through the third input terminal;

a second reverse TFT configured to apply the reverse driving voltage to the Q2 node in response to a first carry signal of the (k+2)th stage input through the fourth input terminal; and a third reverse TFT configured to apply the reverse driving voltage to the gate electrode of the discharge TFT as the shift direction conversion signal in response to the first carry signal of the (k+2)th stage input through the fourth input terminal.

16. The display device of claim 15, wherein in a forward shift mode in which the second scan pulse is generated following the first scan pulse, carry signals input to the first and second input terminals serve as a start signal indicating a charging time of the Q1 node or the Q2 node, and carry signals input to the third and fourth input terminals serve as a reset signal indicating a discharge time of the Q1 node or the Q2 node, wherein in a reverse shift mode in which the first scan pulse is generated following the second scan pulse, carry signals input to the third and fourth input terminals serve as a start signal indicating a charging time of the Q1 node or the Q2 node, and carry signals input to the first and second input terminals serve as a reset signal indicating a discharge time of the Q1 node or the Q2 node.

* * * * *